United States Patent [19]

Newcomb et al.

[11] 4,343,467

[45] Aug. 10, 1982

[54] SHORT HITTING BASEBALL BAT

[76] Inventors: Nelson F. Newcomb; Nelson F. Newcomb, Jr., both of Mirror Lake, N.H. 03853

[21] Appl. No.: 168,277

[22] Filed: Jul. 10, 1980

[51] Int. Cl.[3] ..... A63B 69/40

[52] U.S. Cl. ..... 273/26 B; 273/72 R

[58] Field of Search ..... 273/67 R, 72 R, 72 A, 273/26 B, 84 R, 127 R, DIG. 8, DIG. 7, 1 R, 90; 272/1 R, 8 N, 25

[56] References Cited

U.S. PATENT DOCUMENTS

| | | | |
|---|---|---|---|
| 1,986,682 | 1/1935 | Schulz | 273/84 R |
| 2,099,521 | 11/1937 | Herkimer et al. | 273/72 R |
| 3,113,482 | 12/1963 | Hirsch | 273/72 R |
| 3,801,098 | 4/1974 | Gildemeister | 273/72 A |
| 3,830,496 | 8/1974 | Reizer | 273/72 R |
| 3,880,423 | 4/1975 | Kreag | 273/26 B |
| 3,921,978 | 11/1975 | Warren | 273/67 R |
| 4,032,143 | 6/1977 | Muller et al. | 273/72 R |
| 4,149,723 | 4/1979 | Simon | 273/67 R |

*Primary Examiner*—Richard C. Pinkham
*Assistant Examiner*—T. Brown
*Attorney, Agent, or Firm*—C. Yardley Chittick

[57] ABSTRACT

An apparatus for playing a game of baseball with a regulation ball on a field having a size smaller than the conventional baseball or softball field. The apparatus for playing the game is a bat of conventional size but is made of flexible material which will allow the bat to sag or bend noticably as it is waggled back and forth by a batter.

6 Claims, 10 Drawing Figures

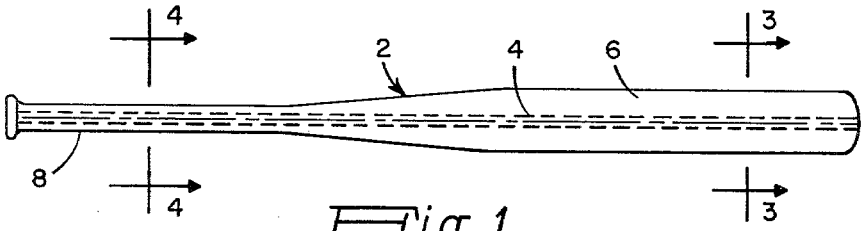
Fig. 1.
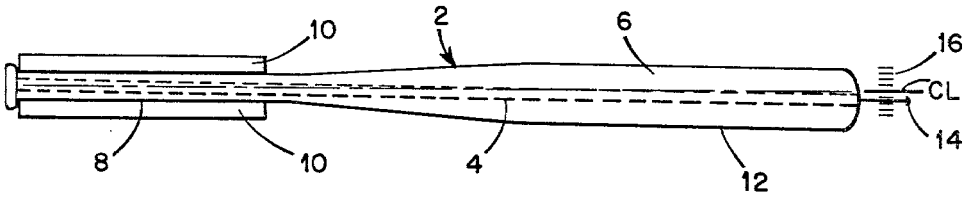
Fig. 2.
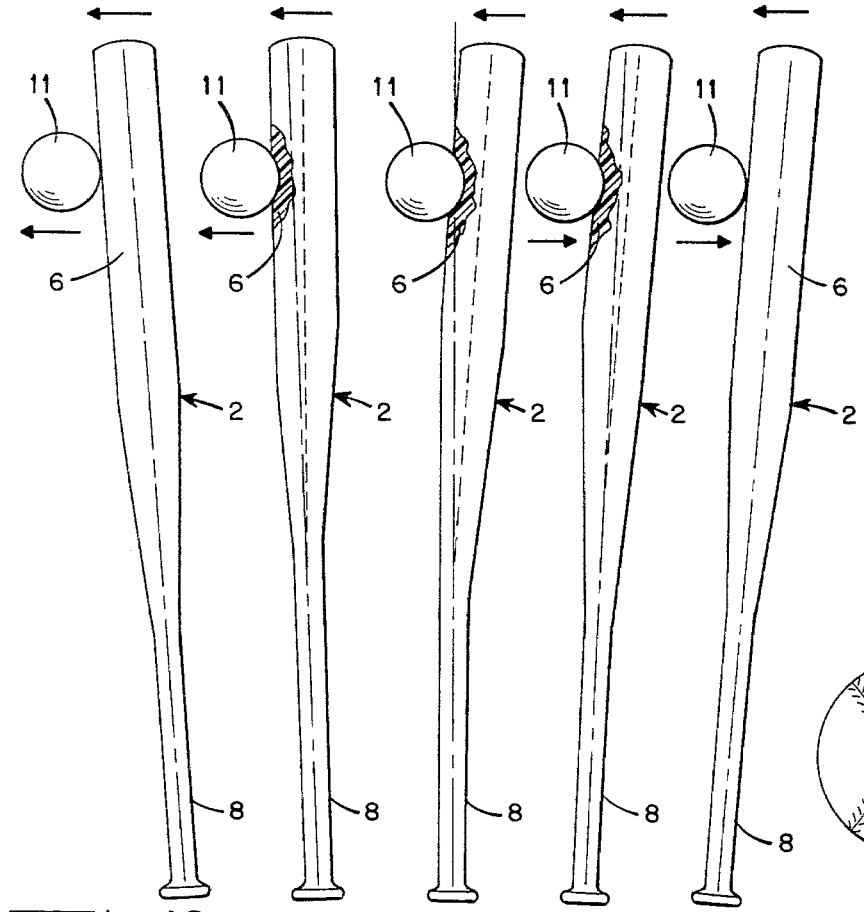
Fig. 10. Fig. 9. Fig. 8. Fig. 7.
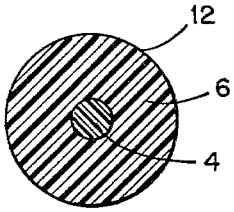
Fig. 3.
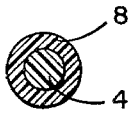
Fig. 4.
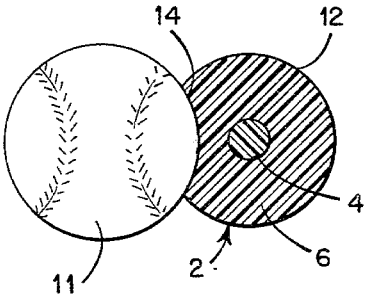
Fig. 5.
Fig. 6.

SHORT HITTING BASEBALL BAT

BACKGROUND OF THE INVENTION

In playing the game of baseball according to the so-called Major League Rules, a large playing field is required. Variations in the rules as to ball specifications, bat sizes and distances between the bases have been made whereby the game in principle can be played in areas of substantially smaller size. However, no means has been devised to date whereby the game can be played in a small area when using a regulation major league ball and a conventional sized bat.

SUMMARY OF THE INVENTION

The present invention contemplates the use of a novel bat of conventional weight, size and shape whereby the game of baseball can be played in a relatively small space. The ball used may be a conventional ball meeting major league rules. The ball will be pitched, thrown and fielded in the usual manner. The novel aspect is the provision of a specially made bat of normal length, weight and appearance which, because of its construction, is unable to drive the ball more than about 50% of the distance it would have traveled if hit with a conventional wooden bat. Because of this limited flight distance, the outfield may be greatly reduced in size. The diamond size preferably will remain unchanged but, if desired, it may be reduced in size to relate better to the slower velocity of the batted ball.

Essential requirements of the bat include a relatively stiff, hard flexible core preferably made of a polyester fiberglass rod and a molded body portion of such compressibility that the ball when hit will sink into the body without appreciable deformation of the ball. The body material has a tough tear resisting skin surface and is so flexible that without the core it would not be usable as a bat. The inclusion of the core produces a bat sufficiently stiff for properly directing the bat at the ball but with a degree of flexibility that will distinguish it from a rigid wooden bat.

The total weight of the body and core equals the weight of a wooden bat of the same size so that the novel bat feels to the batter substantially the same as a conventional wooden bat.

BRIEF DESCRIPTION OF THE DRAWINGS

FIG. 1 is a side elevation of the bat in undeflected condition.

FIG. 2 illustrates the inherent flexibility of the bat when the handle part is held in fixed horizontal position.

FIG. 3 is a section taken on the line 3—3 of FIG. 1 to enlarged scale.

FIG. 4 is a section taken on the line 4—4 of FIG. 1 to enlarged scale.

FIG. 5 illustrates the manner in which the bat material is compressed when the ball is hit without deformation of the ball.

FIGS. 6 to 10 illustrate a sequence of bat positions as the bat engages the ball.

DESCRIPTION OF A PREFERRED EMBODIMENT

Referring first to FIG. 1, the bat of our invention is shown in repose and indicated generally at 2. Its shape, length and weight fall within the requirements specified in the Major League Baseball Rules, namely; the length must not exceed 42 inches and the diameter must not exceed $2\frac{3}{4}$ inches. There is no limitation as to weight.

Thus a player in swinging the bat 2 will recognize its similarity to a conventional wooden bat. The most noticeable differences reside in the flexibility of the bat over its length and the compressibility of the bat material particularly at the area that engages the ball.

The bat has a central axially extending core 4 on which the bat material 6 is molded to provide a unitary structure relatively stiff in the handle section while noticeably flexible toward the large end as the player waggles the bat back and forth.

In the preferred form, the core element will extend substantially the full length of the bat but it will be understood the invention includes a shortened core element in which in one form the core may be omitted for a short distance at the large end beyond the normal ball engaging area and where there is less need for support against bending or sagging.

The degree of flexibility is an important aspect of the invention. If the bat were too flexible, it could not be swung with assurance as to its direction. If too stiff, then the ball when hit flies too far. In other words, the diminished flight of the ball is obtained by a combination of longitudinal flexibility and suitable compressibility of the bat body when striking the ball.

Because of the novel bat construction of a fiberglass core covered with a molded flexible plastic having a tough outer skin, the bat is not subject to cracking, breaking or splintering in any baseball use. This further distinguishes our bat from conventional wooden bats.

The inherent flexibility of the bat may be understood by reference to FIG. 2. Here the handle part 8 has been secured in horizontal position by a suitable fixed clamp 10. The striking end 12 comprised principally of the soft molded material 6 is of such weight to cause the bat to bend throughout its unsupported length and the outer end to sag at least $\frac{1}{4}$ inch for the shorter lighter models and up to perhaps $\frac{3}{4}$ inch for the longer, heavier models. The extent of the deflection may be measured by noting the position of an inserted axially extending pin 14 against a fixed background scale 16.

FIG. 3 shows a sectional view taken on the line 3—3 of FIG. 1. The core rod 4 made preferably of polyester fiberglass, is preferably $\frac{1}{2}$ inch in diameter. The body 6 of our 30 ounce bat is approximately $2\frac{1}{2}$ inches in diameter. Thus, at the ball engaging portion of the bat, the core comprises about 4% and the body about 96% of the bat volume.

On the other hand, referring to FIG. 4, which is a section taken on the line 4—4 of FIG. 1, the core at the handle portion of the bat comprises 25% of the handle volume while the molded covering is 75%.

The weight of the core 4 in a 30 ounce bat 34 inches long is approximately 7 ounces while the surrounding body weighs 23 ounces. In all bat sizes in our preferred construction, the weight of the molded body material exceeds the weight of the core element but the weight of the core element per unit of volume is greater than the weight of the molded body material per unit of volume.

FIG. 5 is a section of the bat taken on the line 3—3 of FIG. 1 to which has been added a baseball 11 in the process of being hit by the bat 2 moving at whatever speed can be developed by the batter. At the moment of impact, the forward movement of the bat is retarded slightly under the opposing force applied by the mass of the ball. The bat bends backward substantially in relation to the handle as the batsman's hands continue to advance. The bat material 6 is compressed by the ball 11 and locally deformed as at 14 but there is no appreciable deformation of the ball as occurs when the ball is hit by a conventional wooden bat. Thus the velocity of the ball leaving the bat is the bat speed plus the small additional velocity created by the relatively slow restoration of the deformed bat material to cylindrical condition.

The sequence of bat and ball positions shown in FIGS. 6 to 10 is in further explanation of the preceding paragraph.

In FIG. 6, the ball 11 moving from left to right has just come into contact with bat 2 moving from right to left.

In FIG. 7, ball 11 is being decelerated very rapidly. It is depressing the engaged part of the bat body 6 and because of its momentum, is applying a force sufficient to slow the forward movement of the bat barrel slightly causing the bat, by virtue of its flexibility, to bend backward in relation to the continued forward movement of the handle part in the hands of the batter.

In FIG. 8 ball 11 has made its deepest penetration in bat body 6. Deceleration has ended, bat 2 has been bent backward to its maximum as determined by ball and bat speeds and weights and movement of the ball to the left is about to commence.

In FIG. 9 the ball 11 is moving to the left at bat speed plus the speed added by the body 6 as it is resuming its cylindrical shape. Because of the slow restoration factor of the body material, the speed added to the ball above the bat speed is small.

In FIG. 10 ball 11 is about to leave bat 2 at its maximum velocity, namely, the bat speed plus a small added velocity induced by the restoration of the body material to cylindrical.

It is this relationship of longitudinal flexbility of the bat and compressibility of the bat material on contact with the ball coupled with substantially no deformation of the ball that limits the initial velocity of the ball to little more than the bat speed. This low velocity produces the short ball flight of about 50% of the distance the ball would travel if hit with a wooden bat at the same bat speed.

The degree of compressibility of the molded material comprising the body of the bat may be measured by using a standard durometer. In the bat of our invention, we have found that the desired result of limited ball flight of about 50% of that produced with a wooden bat will be produced when the durometer reading of the body material is in the order of 50 more or less with an upper limit not in excess of 65.

In order that the body material 6 of our bat have sufficient durability to stand long usage, the hitting surface of the bat must be strong enough to withstand the heat and tearing effect that develops from the friction produced in hitting foul balls and pop ups. A suitable tough surface combined with a soft porous interior is obtained by making the body of the bat from self skinning urethane foam. The liquid ingredients are mixed and piped into the bat mold. When the chemical reaction is completed, that part of the mix in contact with the mold develops a smooth tough outer skin differing from the more porous interior. This process is well understood in the molding art.

The novel construction of our bat produces another unobvious result. This is the matter of hitting fungos. It is well understood by baseball players that when using a conventional baseball and wooden bat, a fungo cannot be hit as far as a pitched ball thrown to the batter.

Our bat, on the other hand, can hit a fungo farther than it can hit a pitched ball. The explanation of this unexpected behavior is believed to reside in the relationship of the compressibility of the body material and the inherent flexibility of the bat.

In hitting a fungo, the batter is in effect, hitting a stationary ball. A stationary ball, when hit with our bat will not depress the body material nor bend the bat backward to the same extent that occurs when a pitched ball is hit by our bat (assume the bat speed to be the same in each case). The net effect of these differences is that the fungo leaves our bat at slightly greater speed and hence flies farther than a pitched ball hit with our bat but a much lesser distance than a fungo hit with a wooden bat.

The correlary of this is that with our bat a fast pitch cannot be hit as far as a slow pitch. This is, or course, just the reverse of what occurs when using a wooden bat. In any case, however, the distance the ball travels through the air when hit with our bat will be in the order of 50% more or less of the distance the ball would travel when hit with a wooden bat.

It is intended to cover all changes and modifications of the example of the invention herein chosen for purposes of the disclosure which do not constitute departures from the spirit and the scope of the invention.

We claim:

1. A baseball bat having the capacity of hitting a conventional baseball a much shorter distance than a wooden bat swung at the same speed, said bat comprising a central core of fiberglass and a surrounding body of molded relatively soft plastic in the shape of a conventional baseball bat, said bat being of such flexibility that the large end will sag noticeably when the handle is held in fixed horizontal position.

2. A baseball bat as set forth in claim 1, said fiberglass core being of uniform cross section throughout its length.

3. A baseball bat as set forth in claim 1, the weight of said core per unit of volume being greater than the weight of said molded body per unit of volume.

4. A baseball bat as set forth in claim 1, said molded body made of self skinning urethane foam.

5. A baseball bat comprising an elongated core element and an outer molded portion surrounding said core element in the shape of a baseball bat, said bat being flexible to an extent that it will bend noticeably as it is waggled back and forth by a batsman.

6. A baseball bat comprising an elongated core element and an outer molded portion surrounding said core element in the shape of a baseball bat, said bat being of such flexibility that when the handle portion over a distance of 10 inches is clamped in fixed horizontal position, the large end of said bat will sag under its own weight at least $\frac{1}{4}$ inch.

* * * * *